US005848524A

United States Patent [19]

Lappage et al.

[11] Patent Number: 5,848,524

[45] Date of Patent: Dec. 15, 1998

[54] MANUFACTURE OF YARN SPUN ON CLOSED-END, HIGH DRAFT SPINNING SYSTEMS

[76] Inventors: James Lappage, 12 McLellan Place, Christchurch 8004; Nigel Anthony Gull Johnson, Otahuna Road R.D. 2, Christchurch 8150; Owen Leslie Roger Hartshorn, 14 De Ville Place, Burwood, Christchurch 8004, all of New Zealand

[21] Appl. No.: 869,960

[22] Filed: Jun. 5, 1997

Related U.S. Application Data

[63] Continuation of Ser. No. 403,827, filed as PCT/NZ93/00055, Jul. 14, 1993, abandoned.

[30] Foreign Application Priority Data

Jul. 14, 1992 [NZ] New Zealand ..... 243543

[51] Int. Cl.[6] ..... D01H 5/28

[52] U.S. Cl. ..... 57/315; 57/5; 57/6; 57/75; 57/91; 57/206; 57/207; 57/224; 57/252

[58] Field of Search ..... 57/206, 207, 224, 57/252, 5, 6, 75, 315, 91, 352, 328

[56] References Cited

U.S. PATENT DOCUMENTS

| | | | |
|---|---|---|---|
| 3,102,379 | 9/1963 | Eble et al. . | |
| 3,599,416 | 8/1971 | Reuter et al. | 57/315 |
| 3,739,566 | 6/1973 | Smith | 57/315 |
| 3,811,263 | 5/1974 | Newton . | |
| 3,822,543 | 7/1974 | Edagawa et al. | 57/224 |
| 3,851,698 | 12/1974 | Leach et al. | 57/315 |
| 4,383,403 | 5/1983 | Nakayama et al. | 57/207 |
| 4,387,487 | 6/1983 | Nakahara et al. | 57/315 |
| 4,495,761 | 1/1985 | Nakayama et al. | 57/328 |
| 4,598,537 | 7/1986 | Kroupa et al. | 57/328 X |
| 4,711,080 | 12/1987 | Shibazaki et al. | 57/207 |
| 4,718,225 | 1/1988 | Sanagi | 57/328 |

FOREIGN PATENT DOCUMENTS

| | | | |
|---|---|---|---|
| 396598 | 3/1980 | Australia . | |
| 893708 | 10/1982 | Belgium . | |
| 72664 | 2/1983 | European Pat. Off. . | |
| 60-110931 | 6/1985 | Japan | 57/315 |
| 1583493 | 8/1990 | U.S.S.R. | 57/315 |
| 1167156 | 10/1969 | United Kingdom . | |

*Primary Examiner*—William Stryjewski
*Attorney, Agent, or Firm*—Watson Cole Grindle Watson, P.L.L.C.

[57] ABSTRACT

A twisted yarn structure includes constituent fibers which extend between a surface and a core of the yarn structure so that at least one portion of each fiber is trapped and bound within the yarn structure by portions of other fibers. The fibers can extend cyclically or in random fashion between an inner region and an outer region of the yarn, and can be twisted in subgroups along the length of the yarn structure to be locked in position therein. To produce the yarn structure having fibers which cyclically extend between the inner and outer regions, the fibers of a drafted strand of fibers from front drafting rollers are spun and passed through an oscillating guide before being wound on a spindle. To produce the yarn structure having fibers which randomly extend between the inner and outer regions, a strand of fibers is passed from a nip between first roller pair into a buckling zone between the first roller pair and a second roller pair whose rollers are rotating at a surface speed slower than the rollers of the first roller pair, and thereafter twisted.

12 Claims, 2 Drawing Sheets

MANUFACTURE OF YARN SPUN ON CLOSED-END, HIGH DRAFT SPINNING SYSTEMS

CROSS-REFERENCE TO RELATED APPLICATION

This application is a continuation of application Ser. No. 08/403,827, filed Mar. 21, 1995, now abandoned, which was based upon International Application PCT/NZ93/00055, filed 14 Jul., 1993.

BACKGROUND OF THE INVENTION

The invention relates to the manufacture of yarns from a well-aligned assembly of any type of staple fibre or fibre blend.

In the manufacture of staple fibre yarns from well-aligned fibres, the constituent fibres are processed such that they are firstly untangled and separated from each other in a carding process and then reassembled into a continuous structure in which the fibres are substantially mutually parallel. The parallel arrangement of the fibres is improved in the subsequent processes of drawing or gilling, which also serve to straighten fibres which may be individually hooked, and may be further improved during an optional combing process which also serves to remove very short fibre, small accumulations of fibre which my still be entangled, and pieces of non-fibrous foreign contaminant. After a series of such processes the fibres are assembled into a long continuous rope-like structure of the desired linear density appropriate to the particular spinning machine. Depending on the drafting system employed on the spinning machine, the fibre assembly may at this stage be either a sliver, or a lighter material known as roving. Roving may or may not contain twist, but even when twist is present the fibres remain highly parallel to each other in helical paths within the roving structure. Similarly after spinning the fibres remain in parallel helical paths within the yarn structure.

There are a number of reasons why care is taken in the preparation of a fibre assembly for spinning to ensure a high degree of parallelism between the fibres. Firstly, such well-aligned slivers and rovings allow drafting (attenuations) by high ratios, commonly in excess of 5:1, which contributes significantly to the economy of processing costs; secondly, a maximum of fibre extent is available to contribute to the tensile strength of the yarn; thirdly, the yarn is densely compacted, lean and smooth, which is desirable for the manufacture of compact cloths of smooth and clear finish; and fourthly, the finest yarn may be spun from a given fibre quality.

A yarn from such a well-aligned fibre assembly does, however, have some disadvantages. As a fibre is drawn from the fibre assembly into the twisting zone by the drafting means (usually a roller pair), its position relative to other fibres simultaneously being drawn into the yarn remains substantially constant, so that as it is twisted about other fibres in the twisting zone to form the spun yarn structure, it takes up a helical path of substantially constant radius. Consequently, the yarn is composed of fibres lying in parallel helical paths.

It will be readily understood that in a highly organised yarn structure in which the constituent fibres lie in parallel helical paths of constant radius, there is a very high probability that some fibres lie entirely on the yarn surface. Such fibres are held in place by virtue of being wrapped around other fibres within the body of the yarn and the stability of their position may be enhanced by setting (annealing) those fibres in their helical paths. In spite of this, because of the flexible nature of most fibres, surface fibres can be partially or completely stripped from the yarn by the frictional action of yarn guides during winding, and particularly by the scraping action of a loom reed during weaving. Further, the tensile strength and stability of such yarns depend only upon inter-fibre frictional forces deriving from the internal yarn pressure, which, in turn, derives from the helical fibre paths and fibre tension when the yarn is placed under a tensile stress. When the yarn is subjected to a cyclically varying stress, however, there can occur some incremental inter-fibre movement or drafting, leading eventually to yarn breakdown by drafting. This is accentuated when surface fibres are continually being stripped from the yarn, which reduces the twist factor and hence reduces the internal yarn pressure. Further, fibres which lie wholly close to the yarn surface are subject to relatively few contacts with other fibres and so are more readily able to draft rather than develop tension when under stress. This lower level of tension in the outer fibres also leads to less inter-fibre pressure in the interior of the yarn and a higher propensity for drafting of fibres throughout the yarn structure. Yet another disadvantage of this structure is that many fibre ends tend to protrude above the yarn surface. Such protruding fibre ends or hairs can be easily snagged, rendering even easier their removal from the yarn, or they can entangle with neighbouring yarns in applications such as a weaving warp, especially if the yarn is caused to rotate.

Yarns spun from well-aligned fibres by conventional means have a small degree of resistance to these problems because many fibres do not remain strictly at the same radius about the yarn axis, but may lie in a helical path of varying radius. This variation in radial position of the fibre is known as fibre migration. Two causes of migration which can occur during conventional spinning are described in the literature. The 'tension mechanism' is due to the tension of fibres on the outside of the forming yarn progressively increasing because of their greater path lengths so that they force their way inwards to replace inner fibres which have gone slack. It has been proposed that this mechanism is hindered by higher overall spinning tension. The 'geometric mechanism' occurs it the twisting is of a form known as the wrapped ribbon form and requires the fibres to change their position in the ribbon emerging from the front roller nip. In ring spinning, for example , the fibre position under the front roller nip is unlikely to change much because of the draft employed, and so the geometric mechanism is of little significance. These naturally occurring mechanisms of migration do not however result in a yarn capable of withstanding the vigorous mechanical action of certain processes such as weaving.

The weaving process includes an abrasive action on the warp by the reed and heddles, a cyclically varying tensile stress due to the shedding and beat-up motions, and a cyclic rotation (amounting to repeated untwisting and twisting of the yarn) due to the rubbing action of moving machine parts. Singles yarns spun from well-aligned slivers or rovings invariably fail during weaving by the mechanisms described above, and are almost universally considered unsuitable for weaving as warp. In order to overcome these deficiencies such yarns are commonly twisted together to form twofold or threefold yarn structures to be woven as warp. The relatively loosely bound surface fibres of a singles yarn then becomes bound by the other ply or plies so that they cannot be stripped off, and yarn breakdown during weaving is substantially eliminated. For this reason, worsted cloths are commonly woven using twofold yarns in the warp, but this expedient introduces further disadvantages. Apart from the added cost of the two-folding process, there is a lower limit upon the weight per unit area of cloth which can be woven which depends primarily upon the linear density of the yarn.

The plying process may be imitated at the spinning frame by combining, within the twisting zone, two rovings initially separated in the drafting zone. Superimposed on the net yarn twist is a small level of false twist which is generated in the two drafted strands which effect the entrapment of the surface fibres of one strand by the other strand. Further, loose surface fibres rotating about one strand are also trapped by the other strand. While this allows a more compact and slightly finer warp yarn to be produced, it still requires two rovings to be prepared for each yarn, and still cannot be spun as fine as a conventional singles yarn.

As an alternative to plying the yarn, it is known to apply an adhesive, usually natural or synthetic size, to the yarn surface in order to glue loosely bound surface fibres more securely in place, and so prevent their removal or entanglement with neighbouring yarns during the weaving process. Preferably the size solution will penetrate into the body of the yarn, coating all fibres to also reduce the risk of incremental drafting under the cyclically varying forces applied during weaving. However, this expedient has the disadvantages of the added costs of the sizing process, drying the sized yarn, and subsequently washing off the size during finishing of the woven cloth.

An object of the present invention is to provide a yarn structure spun from a well-aligned sliver or roving, in which the fibres do not lie in parallel helical paths of constant radius and none of the fibres lie wholly on the yarn surface, and part, or parts, of every fibre is bound within the yarn structure by part or parts of other fibres in the yarn.

Another object of the invention is to provide in a singles yarn structure, a degree of additional fibre migration and inter-fibre entanglement to enhance the yarn performance by inhibiting removal of individual fibres from the yarn structure.

It is a further objective of the invention to provide a yarn structure which is resistant to many of the problems commonly associated with yarn spun from a well-aligned sliver or roving, such as fibre shedding during processing and loss of product appearance due to gradual breakdown of the yarn structure in service.

Another object of the invention is to provide a singles yarn structure, spun from a well-aligned sliver or roving, which is weavable directly as warp without the need of sizing or plying.

A further object of the invention is to provide a method and means for modifying the paths of fibres during, and as part of the spinning operation, so as to generate increased levels of fibre migration within the yarn structure.

SUMMARY OF THE INVENTION

This object may be achieved in a number of ways, for example by cyclically varying the tension of individual fibres as they enter the forming yarn; by buckling and disorienting the fibres before they receive twist; by arranging for small groups, or sub-groups, of fibres to twist into discrete strands with false twist prior to the final convergence of all of the fibres into the yarn with real twist; or by any combination of these effects.

According to a first aspect of the invention, a yarn structure is provided in which each of the constituent fibres migrates between the surface and the core of the yarn so that part or parts of each fibre are trapped and bound by parts of other fibres in the yarn cross-section.

According to a second aspect at the invention a yarn structure is provided in which the constituent fibres migrate cyclically between the core and the surface of the yarn.

According to a third aspect of the invention, there is provided a guide means on a spinning machine which oscillates the yarn cyclically to-and-fro in a plane parallel to the nip of front drafting or deliver rollers of the spinning machine causing fibres to be withdrawn from the front drafting or delivery rollers at a continuously varying angle, acute to the normal direction of withdrawal, such that a proportion of the fibres are subjected to a high tension whilst simultaneously a second proportion of the fibres are subjected to a low, or zero, tension.

According to a fourth aspect of the invention there is provided a yarn structure from which migration or withdrawal of individual fibres is impeded by a degree of inter-fibre entanglement deliberately introduced into the yarn structure.

According to a fifth aspect of the invention, there is provided a zone through which the fibres must pass in a twistless state with at least a proportion of the fibres in a tensionless or overfeed condition such that part or parts of fibres entering that zone can be caused to deviate from a straight-line path between front drafting rollers of the spinning machine and the point at which twist is inserted between the fibres.

According to a sixth aspect of the invention, there is provided a further pair of rollers forming a nip immediately downstream of front drafting rollers of a spinning machine, which rollers deliver at a speed slower than the delivery speed of the front drafting rollers, so that fibres are overfed by the front drafting rollers whilst the additional rollers serve also to confine yarn twist downstream.

According to a seventh aspect of the invention, there is provided means for spreading the fibres over a wide front upstream of the point at which twist is inserted between the fibres, such means comprising removal of all condensing guides from a drafting system of a spinning machine or their replacement by guides with a lesser condensing action, the use of twistless rovings or slivers, and/or providing an overfeed zone between the front drafting roller and the twist insertion point.

Further aspects of the invention will become apparent from the following description.

BRIEF DESCRIPTION OF THE DRAWING

The present invention will now be described with reference to the attached drawings in which.

DETAILED DESCRIPTION OF THE PREFERRED EMBODIMENT

Figure 1:
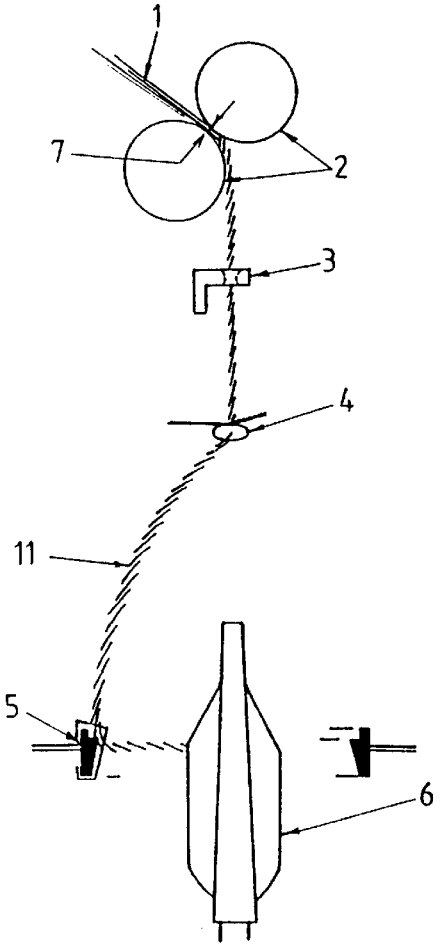
FIG. 1 depicts in cross-section a nip of front drafting rollers of a worsted spinning machine, a spindle, the yarn path and an oscillating yarn guide.

Referring now to FIG. 1, a drafted strand of fibres 1 is delivered by the front drafting rollers 2 to pass through an oscillating guide 3, a pigtail guide 4, a further yarn guide 5 (such as a ring and traveller mechanism) which guides the spun yarn 11 to be wound onto a storage package on a spindle 6.

Figure 2:
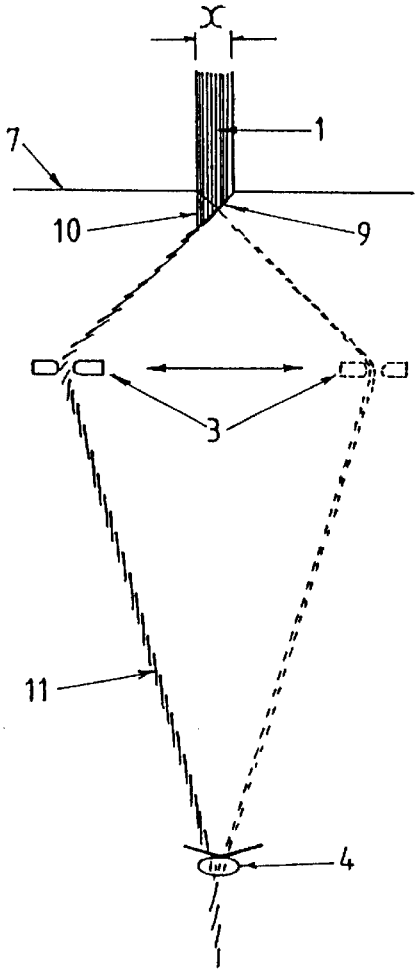
FIG. 2 depicts in plan the nip of the front drafting rollers, the location of fibres within that nip, and the path of the yarn through the oscillating yarn guide at the extreme positions of oscillation of the yarn guide.

Referring now to FIG. 2, the drafted strand 1 passing through the nip 7 of the front drafting rollers is spun into yarn 11 which then passes through the oscillating guide 3 which is shown in its extreme positions of oscillation. At the nip 7 of the-front drafting rollers 2, the fibres comprising the drafted strand 1 are spread over a finite distance X as they enter and emerge from the nip 7. When the oscillating guide 3 is at its extreme left-hand position, a fibre 9 emerging from the nip 7 at the right-hand side of the fibre stream 1 is subjected to a high tension, whilst a fibre 10 emerging from the left-hand side of the nip 7 is at low tension or slack. The difference in tension between fibres 9 and 10 causes the fibre 9 to migrate towards the core of the yarn 11 and the fibre 10 to migrate towards the surface of the yarn 11. When the oscillating guide 3 moves to its extreme right-hand position (dotted), fibre 10 is now tensioned, causing it to migrate towards the core of the yarn 11, whilst fibre 9 becomes slack, causing it to migrate towards the surface of the yarn 11. All other fibres in the strand 1 between fibres 9 and 10 are also subjected to cyclic variations of tension, causing each of them to migrate to some degree within the body of the yarn 11, thereby disrupting the parallel fibre arrangement. Preferably, the frequency of oscillation of guide 3 is such that fibres are caused to migrate between the surface and the core of the yarn at least three times over a distance along the yarn equal to the mean fibre length to ensure adequate fibre entrapment.

Figure 3:
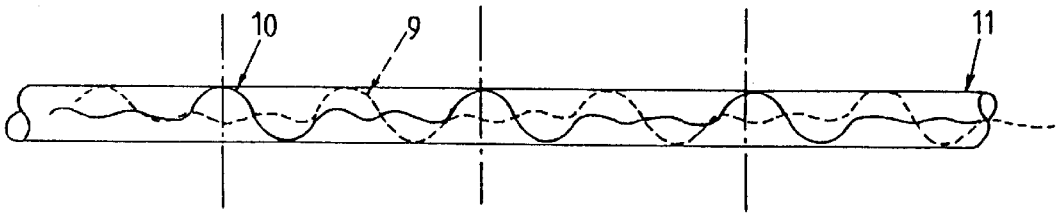
FIG. 3 depicts diagrammatically a short section of yarn and the path followed by two fibres in the yarn structure.

Referring now to FIG. 3, the path of a fibre 10, delivered at the left-hand side of the fibre stream 1 in FIG. 2, is depicted as a full line migrating from the surface of the yarn 11 to the core, back to the surface and finally back to the core. A fibre 9, delivered from the right-hand side of the fibre stream in FIG. 2 is depicted as a broken line, following a similar path between the core and the surface of the yarn, but 180° out of phase with the path of fibre 10. Thus each of the fibres 9 and 10 become bound with the yarn structure, first the one by the other then the other by the one, successively, along the length of the yarn, and similarly acting upon and being acted upon by every other fibre within the yarn cross-section.

Figure 4:
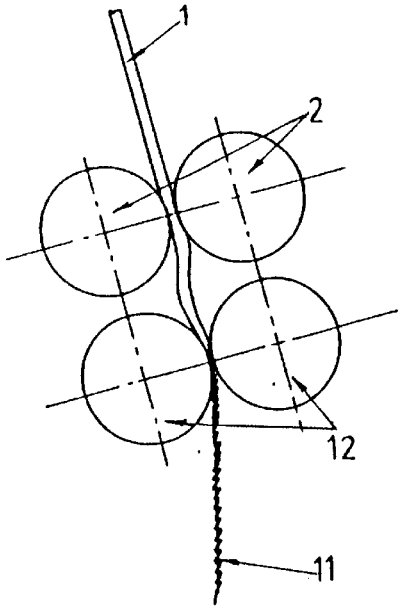
FIG. 4 depicts in cross-section the nip of font drafting rollers of a staple fibre spinning machine, the nip of an additional pair of rollers, a zone of overfeed between the two roller nips, and the yarn path through that zone.
Figure 5:
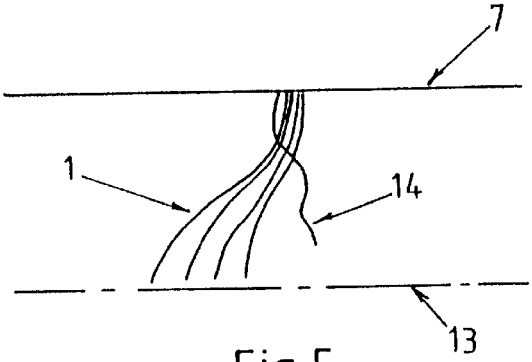
FIG. 5 depicts in plan the nip of front drafting rollers of a staple fibre spinning machine, the nip of an additional pair of rollers, the location of fibres between the two nips, the path of the fibre stream between the two nips and one possible path of one fibre between the two nips.

Referring now to FIG. 4, an additional pair of nip rollers 12, immediately downstream of the front draft rollers 2, is driven (by means not shown) at a surface speed less than the delivery speed of the front drafting rollers. The drafted strand 1 is now caused to buckle in the zone between the nips 7 and 13 of the two pairs of rollers and to migrate to-and-fro across the nip 13 of the additional rollers 12 in order to accommodate the lower speed of the additional rollers. Whilst fibres in the main stream of fibres migrate to-and-fro in order to effect passage of overfed fibre through the nips 13 of the slower rollers 12, a given fibre 14 (FIG. 5) just entering the overfeed zone can cross that zone unimpeded at the delivery speed of the front drafting rollers 2 until it is caught up by the nip 13 of the additional rollers 12. In making that passage unimpeded the fibre 14 has the chance to change its position relative to the main stream of fibres 1, with the possibility of becoming located on the opposite side of the main fibre stream as shown, or at least located with some other different relativity. Similarly, a fibre leaving the grip of the front drafting rollers will no longer be under the influence of the buckling action and also has the chance to change its position relative to the main stream of fibres.

Further, fibres within the main stream may change their position relative to others under the buckling action as a consequence of their individual nature, variations in their bending rigidity along their length, fibre crimp and air turbulence in the region between the two nips.

By the above means, every fibre passing through the overfeed zone has the possibility of changing its relative position as the main fibre stream buckles, spreads under the buckling action and is caused to migrate to-and-fro within the nip of the additional rollers.

Figure 6:
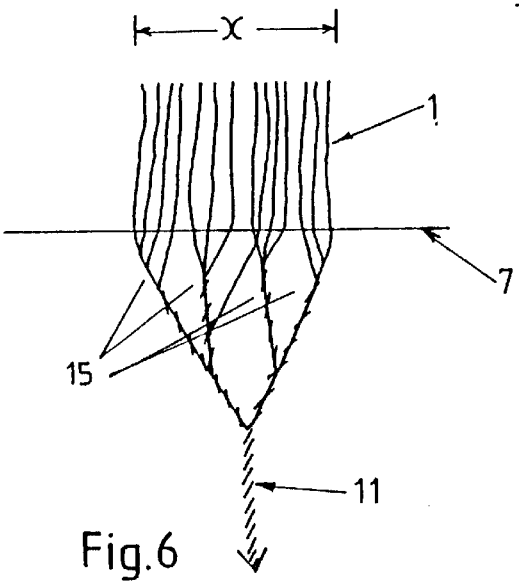
FIG. 6 depicts in plan the location of fibres within the nip of front drafting rollers (or additional rollers), spread over a wide spacing with sub-groups of fibres twisting together under the action of false twist before all of the fibres become twisted together to form the yarn.

FIG. 6 depicts in plan the fibres in the drafted strand 1 spread over a wide front of width X within the nip 7 of the front drafting rollers 2 (or similarly within the nip 13 of an additional pair of rollers 12), and being drawn together by the condensing action of twist into a yarn 11. When the fibre stream is spread over a wide enough distance X, sub-groupings 15 of fibres may form downstream of the roller nip 7 (13), the fibres in each sub-group becoming twisted together in separate sub-strands by false twist which generates by the action of spinning twist under these geometrical conditions. The magnitude of this effect increases with increasing fibre spread, so that when the fibre spread is of the order of several millimeters, the fibre sub-strands 15 behave as separate, very fine yarns before they are finally converged to form the yarn 11. Under these conditions some of the false twist in the separate fibre groupings becomes entrapped with the main structure of the yarn 11, either during build-up of the false twist or when the false twist is decaying due to changing geometry or size of the fibre sub-group. The false twist built into the yarn in this way will vary in both sense and intensity with an algebraic sum of zero in an infinite length of yarn, and will serve to bind individual fibres securely within the yarn structure. The sub-groups of fibres form and decay relatively rapidly and randomly, and individual fibres can migrate from one sub-group to another, contributing to two or more sub-groups within the yarn structure. Further, loose fibre ends protruding from the surface of a fibre sub-group will rotate with the rotating sub-group under the influence of twist insertion and will be constrained and possibly captured as they pass between neighbouring sub-groups. These trapped loose fibre ends will thus be bound into the yarn structure as the sub-groups converge thereby reducing yarn hairiness as well as increasing the overall fibre binding within the yarn structure.

Thus, by this invention there is provided a variety of methods and apparatus for spinning a yarn from a well-aligned sliver or roving in which part or parts of all of the fibres are bound within the yarn structure by part or parts of other fibres in the yarn such that no fibres exist lying wholly on the surface of the yarn and the fibres do not lie in parallel helical relationships over a significant length within the yarn structure. Thus, this yarn exhibits a significantly increased resistance to abrasion, loss of fibre or general breakdown of the yarn structure during further processing as yarn, or during use or service in end products. The yarn is also significantly less hairy than conventionally spun yarns with greatly increased resistance to yarn failure during weaving, and is economically weavable.

The yarn may be spun from a single end of sliver or roving, or by drafting two or more sliver or rovings together, side-by-side and in close contact, to improve the yarn evenness through the effect known as doubling, or, through the rovings differing for example in color or fibre type, to provide an effect yarn.

Particular examples of this invention have been described and it is envisaged that modifications and variations can take place without departing from the scope of the appended claims.

We claim:

1. A method of producing a yarn which is resistant to shedding and is weavable directly as warp without need for sizing or plying, comprising the steps of:

(1) providing first and second pairs of rollers defining respective first and second nips therebetween, said first and second pair of rollers defining a buckling zone therebetween, (2) driving said first pair of rollers at a first rotational velocity and said second pair of rollers at a second rotational velocity, such that said second pair of rollers has a slower surface speed than a surface speed of the first pair of rollers, (3) passing a strand of staple fibres comprised of longitudinally generally parallel fibres through said first nip, through said buckling zone and through said second nip, said fibres of said strand of fibres buckling and spreading apart in said buckling zone, and (4) twisting said fibres of said strand of fibres as said fibres pass out of said second nip so as to form said yarn.

2. A method according to claim 1, wherein said strand of staple fibres comprises at least one sliver.

3. A method according to claim 1, wherein said strand of staple fibres comprises at least one roving.

4. A yarn which is resistant to shedding and is weavable directly as warp without need for sizing or plying which is made by the steps of:

(1) providing first and second pairs of rollers defining respective first and second nips therebetween, said first and second pair of rollers defining a buckling zone therebetween, (2) driving said first pair of rollers at a first rotational velocity and said second pair of rollers at a second rotational velocity, such that the second pair of rollers has a slower surface speed than a surface speed of said first pair of rollers, (3) passing a strand of staple fibres comprised of longitudinally generally parallel fibres through said first nip, through said buckling zone and through said second nip, said fibres of said strand of fibres buckling and spreading apart in said buckling zone, and (4) twisting said fibres of said strand of fibres as said fibres pass out of said second nip so as to form said yarn.

5. A yarn according to claim 4, wherein at least a portion of a length of each fibre of said yarn is bound within said yarn by other fibres.

6. A yarn according to claim 5, wherein a plurality of said fibres of said yarn are bound together in at least a twisted subgroup.

7. A method of producing a yarn which is resistant to shedding and is weavable directly as warp without need for sizing or plying, comprising the steps of:

(1) providing first and second spaced feed means which define a buckling zone therebetween, (2) conveying a strand of staple fibres comprised of longitudinally generally parallel fibres to said first feed means, (3) delivering said strand of staple fibres from said first feed means into said buckling zone at a first velocity, (4) conveying said strand of staple fibres from said buckling zone to said second feed means, (5) delivering said strand of staple fibres from said second feed means downstream therefrom at a second velocity which is less than said first velocity, such that said strand of staple fibres buckles and spreads apart in said buckling zone, and (6) twisting said strand of fibres downstream of said second feed means to produce said yarn.

8. A yarn which is resistant to shedding and is weavable directly as warp without need for sizing or plying which is made by the steps of:

(1) providing first and second spaced feed means which define a buckling zone therebetween, (2) conveying a strand of staple fibres comprised of longitudinally generally parallel fibres to said first feed means, (3) delivering said strand of staple fibres from said first feed means into said buckling zone at a first velocity, (4) conveying said strand of staple fibres from said buckling zone to said second feed means, (5) delivering said strand of staple fibres from said second feed means downstream therefrom at a second velocity which is less than said first velocity, such that said strand of staple fibres buckles and spreads apart in said buckling zone, and (6) twisting said strand of fibres downstream of said second feed means to produce said yarn.

9. A yarn according to claim 8, wherein at least a portion of each fibre of said yarn is bound within said yarn by other fibres.

10. A yarn according to claim 9, wherein a plurality of said fibres of said yarn are bound together in at least a twisted subgroup.

11. A twisted yarn structure spun from at least one strand of well-aligned staple fibres, said twisted yarn structure having an inner region and an outer region which surrounds the inner region and which defines an outer surface, said yarn structure comprising a group of staple fibres which randomly extend along lengths thereof from said inner region to said outer region and back to said inner region along a length of said yarn structure such that a portion of a length of each staple fibre of said group of staple fibres is bound within said yarn structure by portions of lengths of other staple fibres of said group of staple fibres, and no single staple fibre of said group of staple fibres extends along an entire length thereof on said surface of said yarn structure.

12. A twisted yarn structure according to claim 11, wherein a plurality of subgroups of said group of stable fibres are respectively twisted together along portions of the lengths thereof to form twisted subgroups of staple fibres, said twisted subgroups of staple fibres being locked within said twisted yarn structure, individual fibres of said twisted subgroups of staple fibres extending in at least one subgroup.

* * * * *

UNITED STATES PATENT AND TRADEMARK OFFICE

CERTIFICATE OF CORRECTION

PATENT NO. : 5,848,524 
DATED : December 15, 1998
INVENTOR(S) : James Lappage, Nigel A. G. Johnson and Owen L. T. Hartshorn It is certified that error appears in the above-identified patent and that said Letters Patent is hereby corrected as shown below:

Title page,
Item [63], should read -- [63] Continuation of Ser. No. 403,827, filed March 21, 1995 as a U.S. national phase filing of PCT/NZ93/00055, filed July 14, 1993, abandoned. --

Signed and Sealed this

Eleventh Day of June, 2002

*Attest:*

*Attesting Officer*

JAMES E. ROGAN
*Director of the United States Patent and Trademark Office*